United States Patent [19]

Swan

[11] 4,065,047

[45] Dec. 27, 1977

[54] POLYGONAL CARTON WITH BOTTOM REINFORCEMENT AND BLANK THEREFOR

[76] Inventor: Walter B. Swan, 1400 W. 44th St., Chicago, Ill. 60609

[21] Appl. No.: 719,435

[22] Filed: Sept. 1, 1976

Related U.S. Application Data

[60] Continuation-in-part of Ser. No. 719,245, Aug. 31, 1976, which is a division of Ser. No. 601,593, Aug. 4, 1975, Pat. No. 3,977,594.

[51] Int. Cl.[2] ..... B65D 5/10; B65D 5/36

[52] U.S. Cl. ..... 229/41 C; 229/39 R

[58] Field of Search ..... 229/41 B, 41 C, 41 D, 229/39 R, 38

[56] References Cited

U.S. PATENT DOCUMENTS

| | | | |
|---|---|---|---|
| 2,483,464 | 10/1949 | Johnson | 229/7 R X |
| 2,922,562 | 1/1960 | Pellaton | 229/39 R X |
| 3,000,496 | 9/1961 | Larson | 229/41 C X |
| 3,526,352 | 9/1970 | Swett | 229/39 R |
| 3,563,448 | 10/1969 | Croley | 229/23 BT |
| 3,901,431 | 8/1975 | Carlson | 229/41 C X |
| 3,941,300 | 3/1976 | Troth | 229/5.5 |
| 3,977,594 | 8/1976 | Swan | 229/39 R |

FOREIGN PATENT DOCUMENTS

| | | | |
|---|---|---|---|
| 158,551 | 8/1954 | Australia | 229/41 C |

*Primary Examiner*—Davis T. Moorhead

*Attorney, Agent, or Firm*—Cook, Wetzel & Egan, Ltd.

[57] ABSTRACT

The polygonal carton is constructed from a unitary blank of stiff but foldable material and has a reinforced bottom. The blank includes two blank portions divided into at least two, rectangular, side-forming panels. A rectangular webbing is hingedly connected to each blank along a side thereof which is perpendicular to a score line separating the side-forming panels. A line separates the webbings and a portion of the blank along that line is cut and another portion of the blank along that line is scored to form a fold line between the webbings. Each webbing has a plurality of triangular bottom-forming panels therein, each hingedly connected to one of the side-forming panels and a plurality of webs, each extending between and hingedly interconnecting an adjacent pair of bottom-forming panels. Each web has a fold line therein. When the blank is folded into a carton, each web is folded approximately 180° at the fold line to form a reinforcing rib and at least one of the fold lines in one of the folded webs then extends along a line which is parallel to the folded side panels and extends downwardly from a junction between two triangular bottom panels interconnected by that web. With this construction, a load which is placed on the bottom and which urges the bottom panels downwardly is supported by the locking and bearing engagement between the abutting edges of the bottom panels and by the reinforcing ribs formed by the folded interconnecting webs.

16 Claims, 8 Drawing Figures

POLYGONAL CARTON WITH BOTTOM REINFORCEMENT AND BLANK THEREFOR

This application is a continuation-in-part of my earlier application Ser. No. 719,245, filed on Aug. 31, 1976, which is a division of my earlier application Ser. No. 601,593, filed on Aug. 4, 1975, and now as issued U.S. Pat. No. 3,977,594.

BACKGROUND OF THE INVENTION

1. Field of the Invention

The present invention relates to polygonal cartons and more specifically to a polygonal carton made from a unitary blank of stiff but foldable material and having a reinforced, weight-supporting botton. The carton of the present invention has an even number of sides, i.e., four, six, eight, etc. and the embodiments of the invention illustrated in the drawings have six sides. Cartons having six or more sides approach a cylindrical, drum or bushel-basket shape. Polygonal cartons of this type are presently classified in class 229, subclasses 37, 39, 41 and related subclasses.

2. Description of the Prior Art

Heretofore, various polygonal cartons made from a unitary paperboard blank have been proposed. Also, polygonal cartons and containers having a reinforced botton have been proposed. Examples of the previously proposed polygonal cartons and containers made from a unitary blank and/or having a reinforced bottom are disclosed in the following patents:

| U.S. Pat. Nos. | |
|---|---|
| 1,909,649 | 3,000,496 |
| 2,000,210 | 3,071,308 |
| 2,483,464 | 3,559,871 |
| 2,517,552 | 3,526,352 |
| 2,565,182 | 3,700,161 |
| 2,761,611 | 3,768,720 |
| British Pat. No. | 1,201,192 |
| Canadian Pat. No. | 500,929 |
| French Pat. No. | 1,559,856 |

As will be described in greater detail hereinafter, the polygonal carton with botton reinforcement of the present invention is particularly adapted for use in place of drums or cylindrical containers presently used for storing fluid material having significant weight.

Further information about polygonal cartons and particularly about a polygonal carton having substantial weight supporting capacity similar to the polygonal carton described herein can be found in U.S. Application, Ser. No. 601,593, filed Aug. 4, 1975, and now issued to U.S. Pat. No. 3,977,594, the subject matter of which is incorporated herein by reference.

As will be discussed in detail hereinafter, the polygonal carton of the present invention is a further embodiment of the polygonal carton described and claimed in the above-identified application and provides a polygonal carton having a reinforced bottom construction which has significant weight-supporting capacity.

SUMMARY OF THE INVENTION

According to the invention there is provided a polygonal carton having a plurality of side panels and a strong weight supporting bottom formed by a plurality of generally triangular bottom panels equal in number to said side panels and a plurality of interconnecting webs, each web extending between a pair of adjacent bottom panels, each said bottom panel being hingedly connected to one of said side panels, being inclined upwardly from the bottom edge of the side panel to which it is connected so as to form an acute angle therewith, having two side edges which abut adjacent side edges of adjacent bottom panels and having said webs on either side thereof hingedly connecting said bottom panel to an adjacent bottom panel, and each said web having a fold line therein which divides said web into two rib sections and being folded approximately 180° at said fold line to form a double-ply reinforcing rib, at least one of said fold lines extending along a line which is parallel to said side panels and which extends downwardly from a point coincident with the apexes of two adjacent bottom panels interconnected by that web, whereby a load which is placed on said bottom and which urges said bottom panels downwardly will be supported by the locking and bearing engagement between said abutting edges and said bottom panels and by said interconnecting webs.

Also according to the invention there is provided a unitary blank capable of being folded into a carton having a strong weight supporting bottom, said blank being made of stiff but foldable material and including two blank portions, each having at least one score line dividing said blank portion into at least two, generally rectangular, side-forming panels, a continuous, generally rectangular, webbing hingedly connected along a side of said blank portion which is perpendicular to said score line, each said webbing being connected to the other webbing along at least part of a line separating said webbings, a portion of said blank along said line being cut and a portion of said blank along said line being scored to form a fold line between said webbings, and each webbing having therein a plurality of generally triangular, bottom-forming panels equal in number to said side-forming panels, each bottom-forming panel being hingedly connected to one of said side-forming panels, and a plurality of rib-forming webs, each web extending between and hingedly interconnecting an adjacent pair of bottom-forming panels, said bottom-forming panels and webs being configured and dimensioned in such a manner that, when said blank is folded into a carton, adjacent bottom-forming panels abut each other and each web therebetween folds into a reinforcing rib hingedly connected to and between each pair of adjacent bottom panels.

DESCRIPTION OF THE PREFERRED EMBODIMENTS

Figure 1:
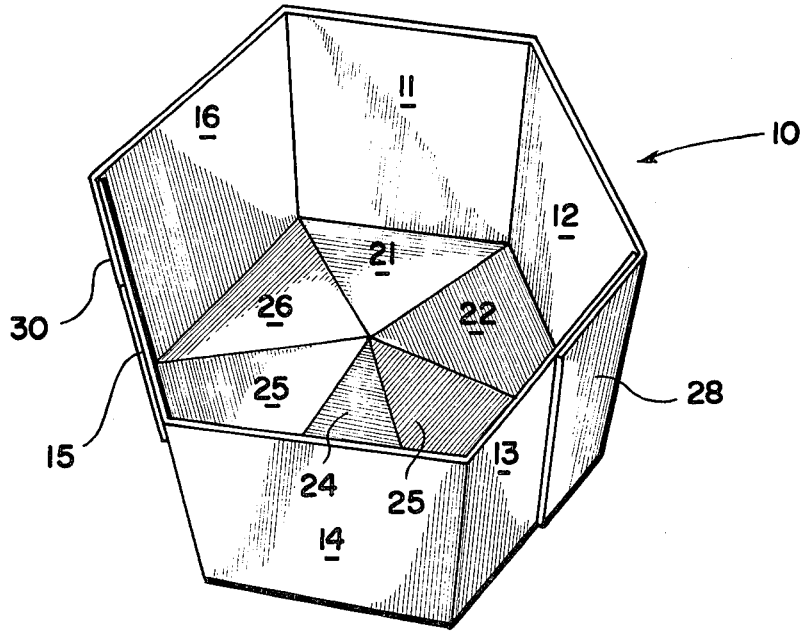
FIG. 1 is an elevational perspective view of a six-sided carton constructed according to the teachings of the present invention.

Referring now to the drawings in greater detail, a carton 10 made in accordance with the teachings of the present invention is illustrated in FIG. 1. As shown, the carton 10 has six side panels 11–16 and six generally triangular bottom panels 21–16. Each of the bottom panels 21–26 inclines upwardly from the bottom edge of the side panel 11–15 or 16 to which it is connected so as to form an acute angle therewith. In this way adjacent side edges of adjacent abutting bottom panels 21–26 will bear against each other when a load is placed inside the carton 10 and urges the bottom panels 21–26 downwardly.

Figure 2:
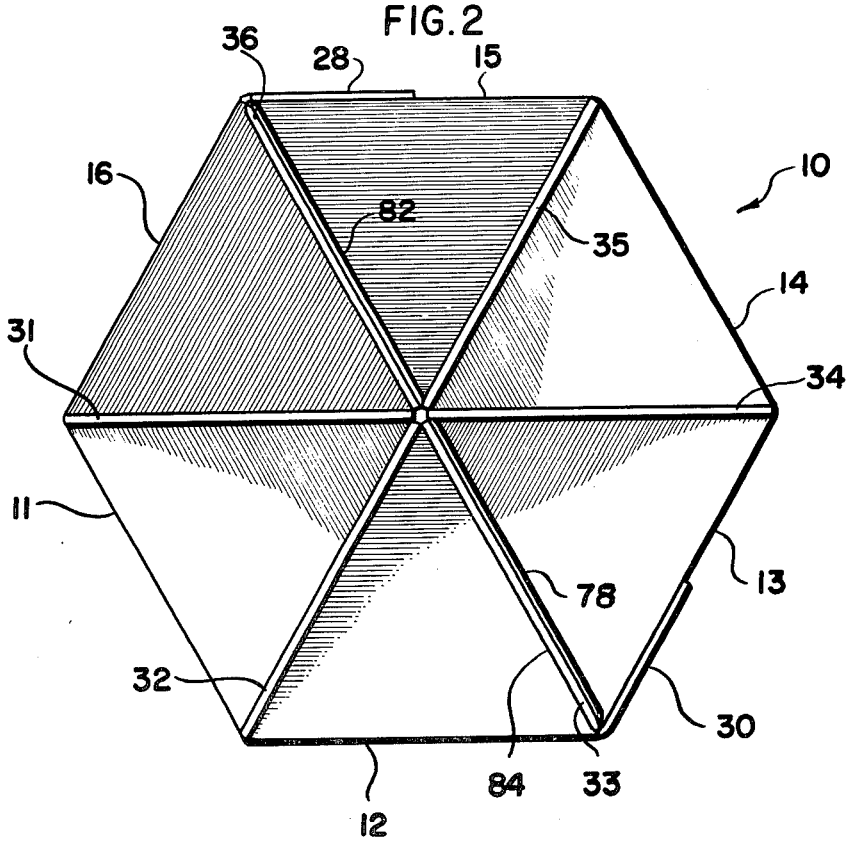
FIG. 2 is a botton plan view of the carton shown in FIG. 1.

Also, and as shown in FIG. 2, the bottom construction for the carton 10 includes a plurality of reinforcing webs 31–36 each of which is formed from a web (webs 61–66 shown in FIG. 3) hingedly connected to and between adjacent bottom panels 21–26.

Additionally, and as shown in FIGS. 1 and 2, side panel 12 has a flap 28 extending therefrom which is secured, such as by an adhesive, to side panel 13. In like manner side panel 16 has a flap 30 extending therefrom which is secured, such as by an adhesive, to side panel 15.

Figure 3:
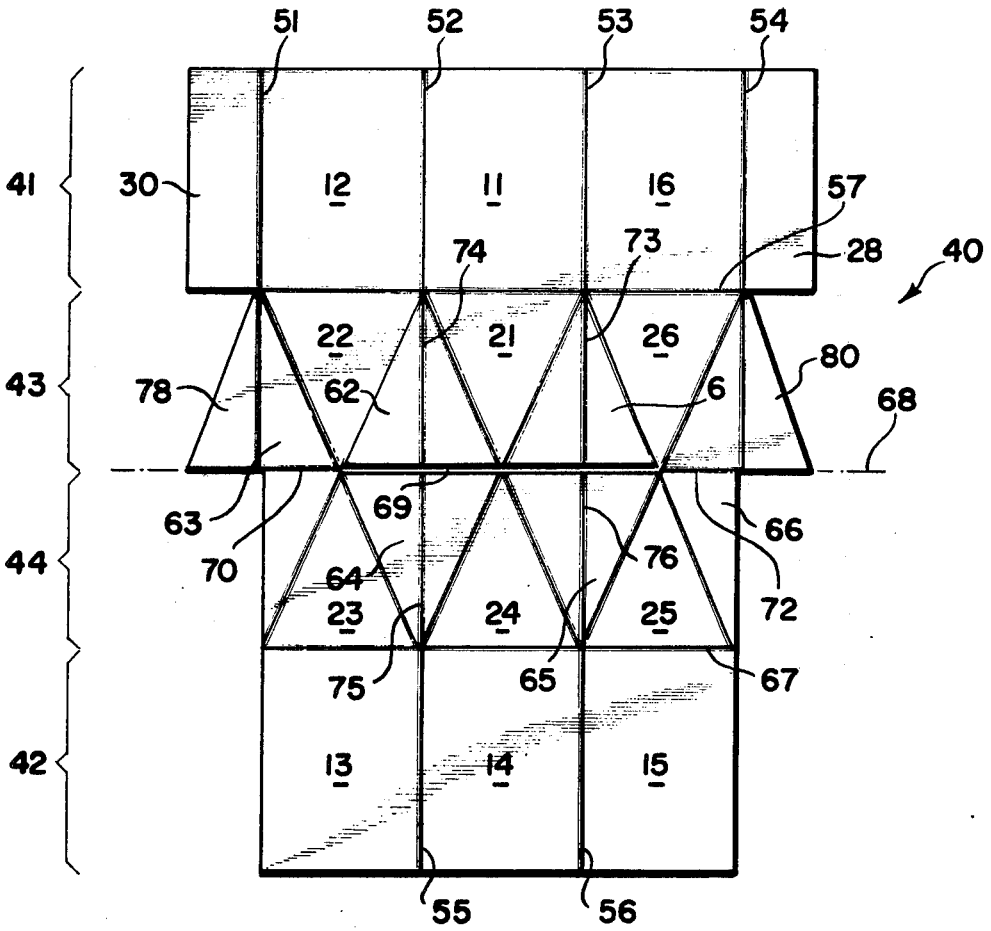
FIG. 3 is a plan view of the paperboard blank from which the carton of FIG. 1 is formed.

Referring now to FIG. 3 there is illustrated therein a unitary blank 40 from which the carton 10 is formed as will be described below. The blank 40 is divided into two blank portions 41 and 42 and two webbings 43 and 44. As shown the blank portion 41 has four parallel spaced score lines 51–54 therein which divide blank portion 41 into three side-forming panels, i.e., panels 11,12 and 16 and two end flaps, i.e., flaps 28 and 30. Flap 28 is hingedly connected along score line 51 to panel 12 and flap 30 is hingedly connected along score line 54 to panel 16. In a similar manner, blank portion 42 is divided by two, parallel spaced score lines 55 and 56 into three side-forming panels, i.e., side panels 13,14 and 15.

The webbing 43 is hingedly connected along a score line 57 to the blank portion 41 along a side thereof which is perpendicular to the score lines 51–54. The webbing 63 includes three triangular bottom-forming panels, i.e., bottom panels 21,22 and 26 and two webs 61 and 62 therebetween with the web 41 hingedly interconnecting panels 21 and 26 and web 32 hingedly connecting bottom panels 21 and 22. Also a portion of a web 63 is situated in, and at one end of webbing 43, the other portion being situated in one end of webbing 41.

In a similar manner, webbing 44 includes three triangular bottom-forming panels, i.e., bottom panels 23,24 and 25 and two webs 64 and 65 therebetween with web 64 hingedly interconnecting panels 23 and 24 and web 65 hingedly interconnecting panels 24 and 25. Also a portion of a web 66 in, and at the other end of, webbing 44 the other portion being situated in the other end of webbing 43. The webbing 64 is hingedly connected along a score line 67 to blank portion 42 along side thereof which is perpendicular to the score lines 55 and 56 therein.

The webbings 43 and 44 are separated along a line 68. A portion of the blank 40 along the line 68 is cut as indicated at 69 and two portions of the blank opposite the cut 69 and along the line 68 are scored to form fold lines 70 and 72 hingedly interconnecting the webbings 43 and 44.

Each of the webs 61–66 has a fold line bisecting the web so as to form two sections which form rib sections when the webbing 61–66 is folded into one of the ribs 31–36. In this respect the web 63 has fold line 70 which is also one of the fold line interconnecting the webbings 43 and 44. Likewise, webbing 66 has the fold line 72 which also serves as one of the fold line hingedly interconnecting the webbings 43 and 44. The webs 61,62,64 and 65 have fold or score lines 73–76 therein which however extend for either the score line 57 or the score line 67 to the cut 69, i.e., fold line 73 in web 61, fold line 74 in web 62, fold line 75 in web 64 and fold line 76 in web 65. Note that fold line 70 extends from the apexes of triangular panels 22 and 23 along the line 68 and likewise fold line 72 extends from the apexes of traingular panels 25 and 26 along the line 68, whereas, the fold lines 73 and 74 extend from the score line 57 hingedly connecting blank portion 41 with webbing 43 and fold lines 75 and 76 extend from the score line 67 hingedly connecting blank portion 42 with webbing 44.

Also, it is to be noted that webbing 43 has a triangular flap 78 at one end and a triangular flap 80 at the other end. Each of these flaps 78 and 80 are hingedly connected to the webbing 43 at a score line. Also, the flaps 78 and 80 are configured to fit over, and adjacent to, the other rib section of the rib formed when web 63, or web 66 is folded, thereby to form a three-ply reinforcing rib. Of course, when the blank 40 is folded, webs 61,62,64 and 65 are folded along the fold lines 73,74,75 and 76 into double-ply reinforcing ribs 31,32,34 and 35.

Figure 4:
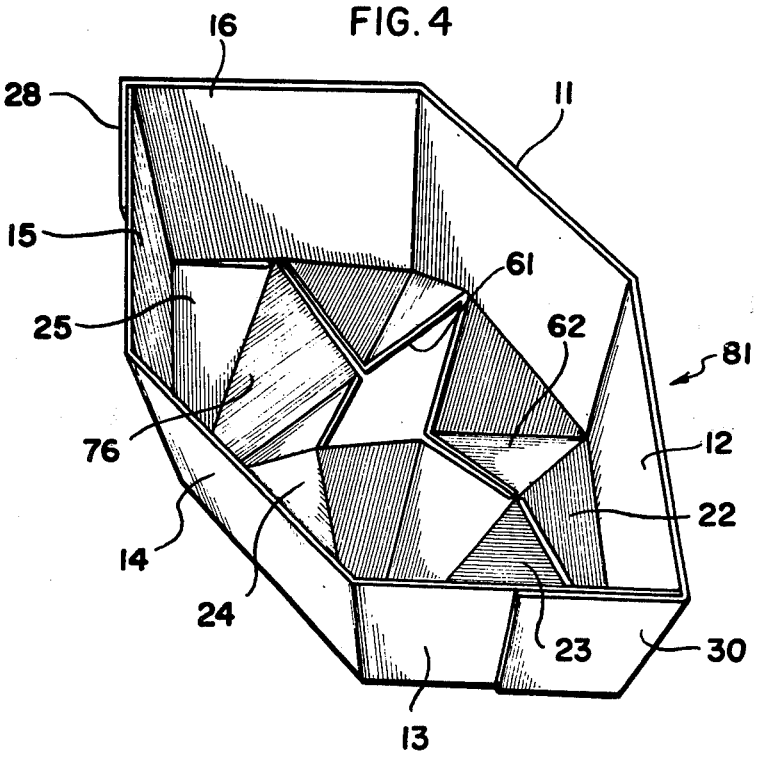
FIG. 4 is an elevational perspective view of the blank shown in FIG. 3 partially folded into the carton shown in FIG. 1.

In constructing the carton 10 from the blank 40, the blank portion 41 and 42 are folded along the score lines 57 and 67 in a direction inwardly of the plane of the blank 40 as shown in FIG. 3. The side panels 11–16 are then folded into place by folding along the score lines 52,53,55 and 56 and flap 28 is secured to the outer side of panel 15 and flap 30 is secured to the outer side of the panel 13 as shown in FIG. 4. The webs 61–64 are then folded along the fold lines 73,74,70,75,76 and 72 in a manner so as to fold the webs 61–66 in half. Each half of each web then forms a rib section and together forming a double-ply rib 31–36 shown in FIG. 2. The folding of the webs 61–66 is best shown in FIG. 4 where a partially folded carton 81 is illustrated. Although not shown, it will be understood that the flap 78 is folded about the rib section of web 63 situated in webbing 44 to form a third rib section which is identified by the reference numeral 82 in FIG. 2 and the similar rib section formed by flap 80 is identified by reference numeral 84 in FIG. 2.

With the panels 21–26 and webs 61–66 configured and dimensioned in the manner described above, when the blank 40 is folded into the carton 10, adjacent side edges of adjacent bottom panels 21–26 abut each other and each web 61–66, therebetween, folds into a double-ply reinforcing rib hingedly connected to and between each pair of adjacent bottom panels 21–26, thereby to provide bottom reinforcement for the bottom of the carton 10. With the carton 10 formed in the manner just described from the blank 40, each web 41–46 is folded approximately 180° at the fold lines 70,72,73,–76 therein, to form a double-ply reinforcing rib and two of the fold line, namely, fold lines 70 and 72 will then extend along a line which is parallel to the side panels 11–16, downwardly from points coincident with the apexes of respective, triangular panels 22 and 23 and triangular panels 25 and 26.

To facilitate the folding of flaps 78 and 80 about the other rib section in the respective webs 63 and 66, the length of webbing 44 excluding the flaps 78 and 80 is slightly shorter than the length of webbing 43 as shown in FIG. 3.

Figure 5:
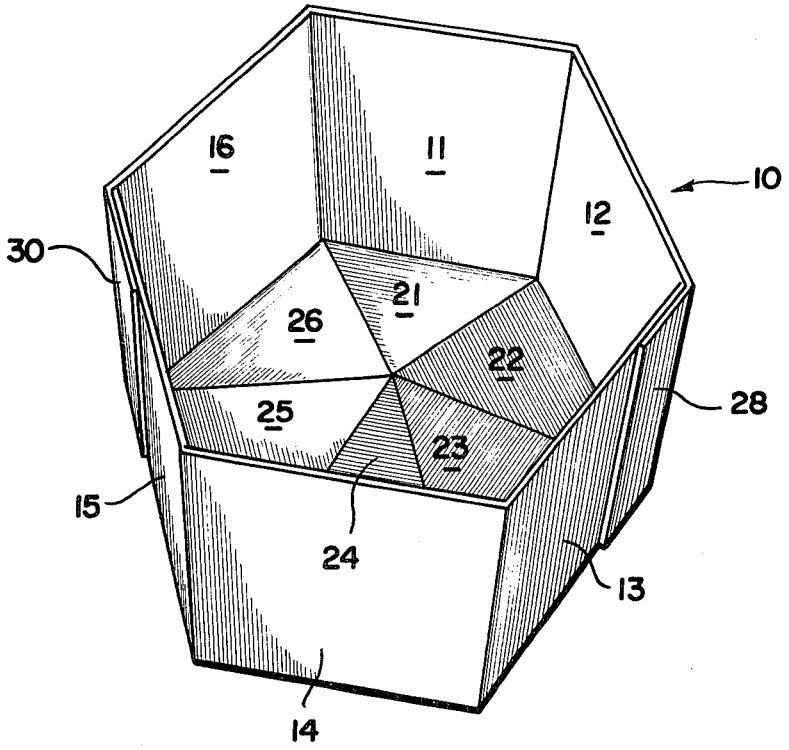
FIG. 5 is an elevational perspective view of another embodiment of a six-sided carton constructed according to the teachings of the present invention.
Figure 6:
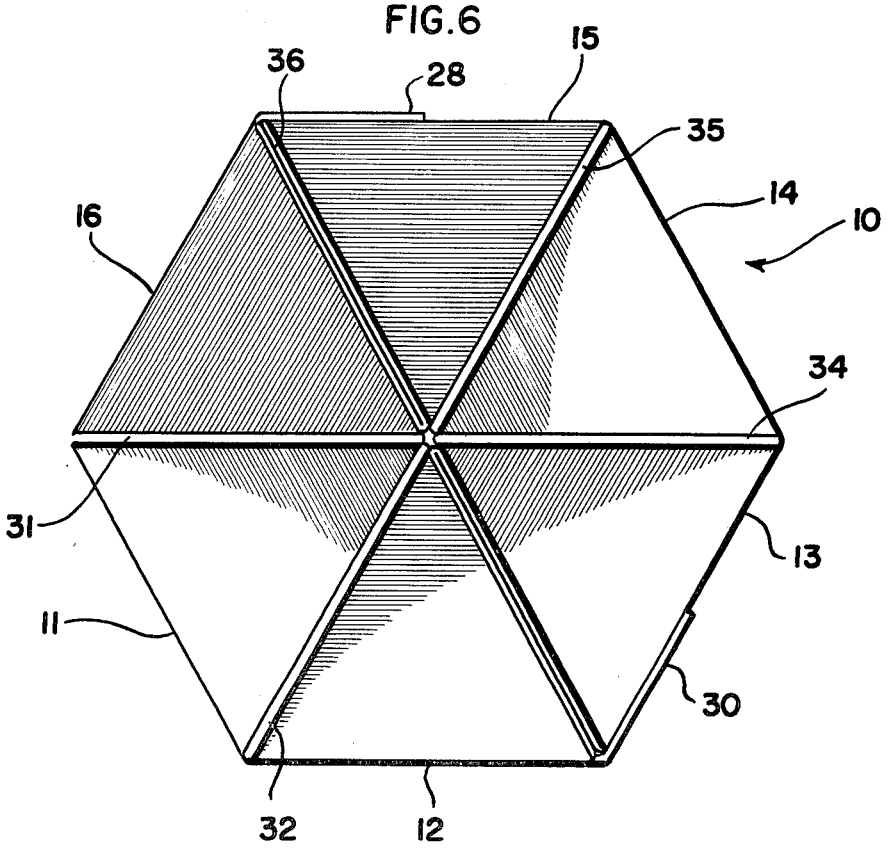
FIG. 6 is a bottom plan view of the carton shown in FIG. 5.
Figure 7:
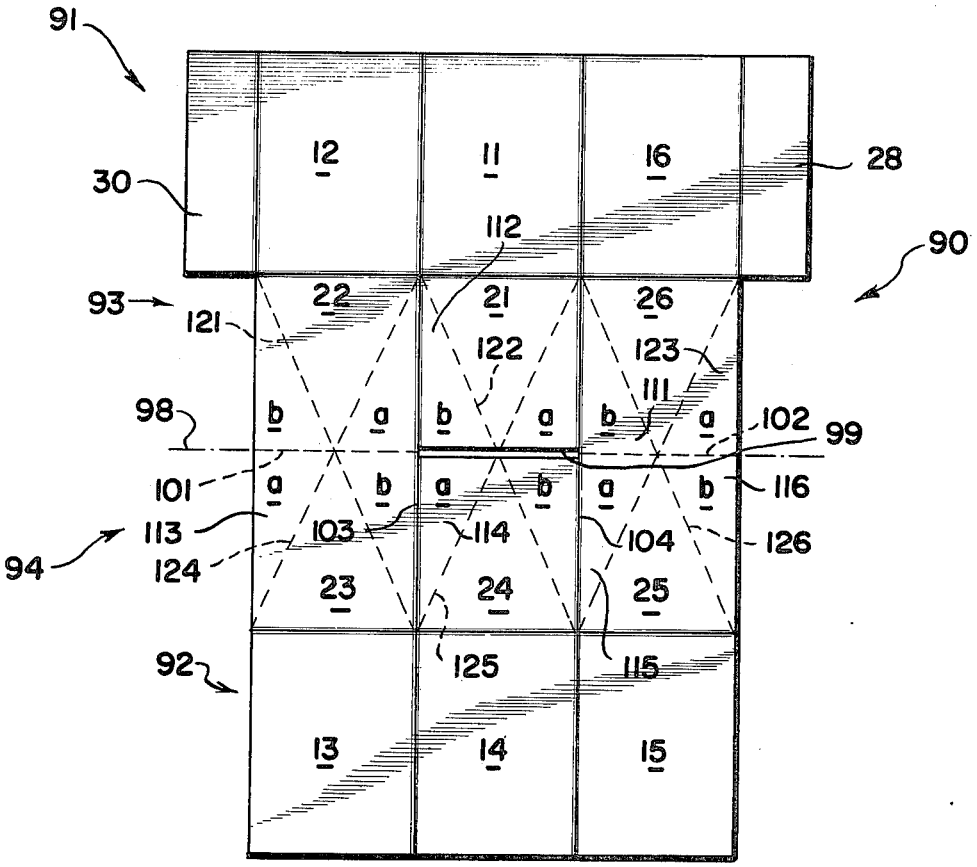
FIG. 7 is a plan view of the paperboard blank from which the carton of FIG. 5 is formed.

The embodiment of the polygonal carton and blank therefor of the present invention shown in FIGS. 5–8 are substantially the same as the carton 10 and blank 40 shown in FIGS. 1–4. Accordingly, except where different features of construction are utilized, identical reference numerals will be utilized for the carton 10. Since the blank shown in FIG. 7 is different than the blank shown in FIG. 3, a different reference numeral will be utilized to identify same.

As shown in FIG. 5, the carton 10 includes six side panels 11–16 and six triangular bottom panels 21–26. Also, and as best shown in FIG. 6, the bottom of the carton 10 has six reinforcing ribs 31–36. Also, the panel 12 is secured by flap 28 to panel 13 and panel 16 is secured by flap 30 to panel 15.

Referring now to FIG. 7, there is illustrated therein a unitary blank 90, including two blank portions 91 and 92 and two webbings 93 and 94. The blank portion 91 includes panels 11,12 and 16 and flaps 30 and 28 defined between parallel spaced score lines. Likewise, blank portion 92 includes panels 13,14 and 15 defined between two parallel spaced score lines.

Webbing 93 is hingedly connected at a score line to blank portion 91. Likewise, webbing 94 is hingedly connected at a score line to blank portion 92, much the same way that webbings 43 and 44 are hingedly connected, respectively, to blank portions 41 and 42 in FIG. 3. However, the webbings 93 and 94 differ slightly from the webbings 43 and 44. First of all the webbings 93 and 94 are separated from each other at a line 98 similar to the separation at line 68 in FIG. 3 and a portion of the blank 90 along the line 98 located centrally of the blank 90 is cut as indicated at 99. However, this cut 99 is shorter than the cut 69 and extends between two score lines 100 and 101 which are extensions of the score lines in the blank portions 91 and 92 which score lines define therebetween panels 11 and 14. Also portions of the blank 90 opposite the ends of the cut 99 are perforated to form fold lines. Together, the webbings 93 and 94 have six webs 111–116 formed therein between spaced apart, intersecting and inclined lines of perforations 121–126. As shown, the lines of perforation 121–126 criss-cross the webbings 93 and 94 to define the panels 21–26 and the webs 111–116. Each of the webs 111–112 has an *a* section and a *b* section, each of which forms a rib section when the blank 90 is folded into the carton 10. In this respect, sections **111*a* and 111*b* are divided by score line 104, sections 112*a* and 112*b* are divided by score line 103, sections 113*a* and 113*b* are divided by the perforated line 101, sections 114*a* and 114*b* are divided by score line 103, sections 115*a* and 115*b* are divided by score line 104 and sections 116*a* and 116*b* are divided by perforated line 102. Since the cut 99 is shorter than the cut 69, the two perforated lines or fold lines 101 and 102 also hingedly connect rib forming sections of oppositely disposed webs in the webbings 93 and 94 on the other side of adjacent bottom panels 22,23,25, and 26. In this respect, rib section 112*a* is hingedly connected along perforation 101 to rib section 114*b*. Likewise, rib section 115*a* is hingedly connected along perforation 102 to rib section 111*b*. Furthermore, in this embodiment, flaps such as flaps 78 and 80 contained in blank 40** are omitted.

Figure 8:
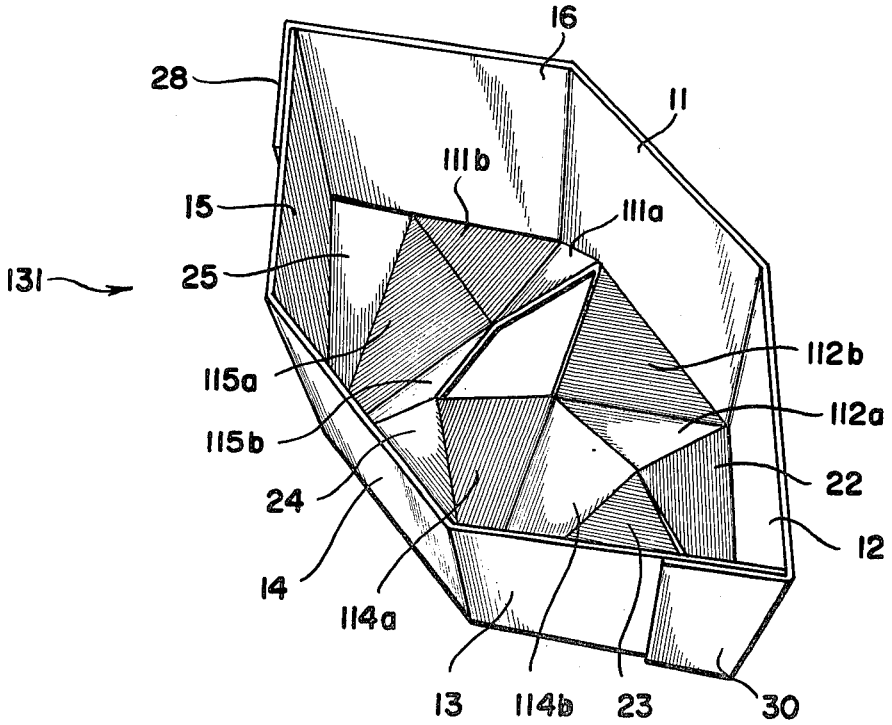
FIG. 8 is an elevational perspective view of the blank shown in FIG. 7 partially folded into the carton shown in FIG. 5.

The blank 90 folds in a similar manner as the blank 40 into the carton 10 and a partially formed carton folded from the blank 90 is shown in FIG. 8 and identified by reference numeral 131. The positions of the various rib sections **111*a*–116*a* and 111*b*–116*b* as the blank 90 is being folded are shown in FIG. 8**.

Although not shown, it will be understood that another embodiment of the blank similar to the blanks 40 and 90 for forming the carton 10 can be constructed with two cuts and one fold line along a line separating the two webbings in the blank. Looking at blank 90, such a modification will have a fold line in place of cut 99 and two cuts in place of perforated lines 101 and 102. Also in such a modification, partial or fully formed flaps similar to flaps 78 and 80 shown in FIG. 3 would be hingedly connected to opposite ends of one of the webbings, e.g., webbing 93, for securement to the adjacent rib section in the other webbing when the blank is folded to form the carton 10 thereby to form a continuous interconnecting web between each pair of adjacent bottom panels.

From the foregoing description, it will be apparent that a carton 10 constructed in accordance with the teachings of the present invention will have a strong weigh supporting reinforced bottom. Also, from the foregoing description, it will be apparent that obvious modifications and variations can be made to the blank, e.g., blanks 40 and 90, from which the carton 10 is formed. Accordingly, the scope of the invention is only to be limited as necessitated by the accompanying claims.

I claim:

1. A polygonal carton having a plurality of side panels and a strong weight supporting bottom formed by a plurality of generally triangular bottom panels equal in number to said side panels and a plurality of interconnecting webs, each web extending between a pair of adjacent bottom panels, each said bottom panel being hingedly connected to one of said side panels, being inclined upwardly from the bottom edge of the side panel to which it is connected so as to form an acute angle therewith, having two side edges which abut adjacent side edges of adjacent bottom panels and having said webs on either side thereof hingedly connecting said bottom panel to an adjacent panel, and each said web having a fold line therein which divides said web into two rib sections and being folded approximately 180° at said fold line to form a double-ply reinforcing rib, at least one of said fold lines extending along a line which is parallel to said side panels and which extends downwardly from a point coincident with the apexes of two adjacent bottom panels interconnected by that web, whereby a load which is placed on said bottom and which urges said bottom panels downwardly will be supported by the locking and bearing engagement between said abutting edges of said bottom panels and by said interconnecting webs.

2. The carton according to claim 1 wherein at least two pairs of adjacent bottom panels are interconnected by a web which has a fold line therein which extends downwardly from a point coincident with the apexes of the adjacent bottom panels interconnected by that web.

3. The carton according to claim 1 wherein at least one of said fold lines lies in a plane which is generally perpendicular to planes containing said side panels and which extends inwardly of the carton from a bottom corner of said carton formed at the junction between two adjacent side panels.

4. The carton according to claim 2 wherein said carton has at least six bottom panels and at least four interconnecting webs, each having a fold line therein which lies in a plane which is generally perpendicualr to planes containing said side panels and which extends inwardly of the carton from a bottom corner of said carton formed at the junction between two adjacent side panels.

5. The carton according to claim 4 wherein each of said four webs defined in claim 4 is hingedly connected to respective adjacent side edges of two adjacent bottom panels along fold lines which intersect each other at a bottom corner of said carton formed at the junction of two side panels, the area of intersection of said fold lines in said carton being integrad with said adjacent side panels, said adjacent bottom panels and the interconnecting web therebetween.

6. The carton according to claim 4 wherein a rib section of one of said webs defined in claim 4 is hingedly connected to a rib section of web which is hingedly connected to a next adjacent bottom panel.

7. The carton according to claim 1 wherein one rib section of said at least one web has a rib-section-forming flap hingedly connected thereto and folded against the other rib section of said web, said other rib section lying between said flap and said one rib section.

8. The carton according to claim 1 wherein at least two of said side panels have one free edge and each side panel adjacent to a side panel with a free edge has a flap for securing that side panel to the adjacent side panel with a free edge.

9. A unitary carton blank capable of being folded into a carton having a strong weight supporting bottom, said blank being made of stiff but foldable material and including two blank portions, each having at least one score line dividing said blank portion into at least two, generally rectangular, side-forming panels, a continuous, generally rectangular, webbing hingedly connected along a side of said blank portion which is perpendicular to said score line, each said webbing being connected to the other webbing along at least part of a line separating said webbings, a portion of said blank along said line being cut and a portion of said blank along said line being scored to form a fold line between said webbings, and each webbing having therein a plurality of generally triangular, bottom-forming panels equal in number to said side-forming panels, each bottom-forming panel being hingedly connected to one of said side-forming panels, and a plurality of rib-forming webs, each web extending between and hingedly interconnecting an adjacent pair of bottom-forming panels, said bottom-forming panels and webs being configured and dimensioned in such a manner that, when said blank is folded into a carton, adjacent bottom-forming panels abut each other and each web therebetween folds into a reinforcing rib hingedly connected to and between each pair of adjacent bottom panels.

10. The blank according to claim 9 wherein each web has a fold line therein which divides said web into two rib-forming sections which, when said blank is folded, are folded onto each other to form a double-ply reinforcing rib.

11. The blank according to claim 10 wherein said fold line for at least two of said webs defined in claim 10 also forms part of, and is coincident with, said fold line between said webbings.

12. The blank according to claim 11 wherein the fold line for at least one web in each one of said webbings extends from a fold line, where one of said blank portions is hingedly connected to one of said webbings, to a line containing said fold line between said webbings.

13. The blank according to claim 12 wherein each said webbing has at least three triangular panels and two webs therin, with one rib section of each of said two webs in each webbng having a free edge defined by said cut and the other rib section of each of said two webs in each webbing being hingedly connected across said fold line between said webbings to a rib section in a web situated in the adjacent webbing.

14. The blank according to claim 9 wherein said fold line between said webbings has two sections with said cut being situated therebetween, each said fold line section interconnecting a rib-forming section at the end of one of said webbings with a rib-forming section in the web at the end of the other webbing, these two rib-forming sections being interconnected at one of said fold line sections to form an interconnecting web between a pair of bottom panels, each situated in a different webbing.

15. The blank according to claim 14 wherein at least one of said rib-forming sections defined in claim 14 has a rib-section-forming flap hingedly connected thereto, and wherein said flap, when said blank is folded into a carton, is folded adjacent the connected rib-forming-section in the other webbing with said connected rib-forming-section situated between said flap and said one rib-forming-section.

16. The blank according to claim 9 wherein each of said blank sections has two free edges parallel to the score lines therein, and at least two of said free edges being spaced outwardly from the free edge of the webbing connected thereto, with a score line provided in that blank portion coincident with the free edge of the connected webbing, such that a flap section is defined between said score line and said outwardly spaced free edge of said blank section, each said flap section, when said blank is folded, being secured to an adjacent side-forming panel having a free edge.

* * * * *

UNITED STATES PATENT OFFICE

CERTIFICATE OF CORRECTION

Patent No. 4,065,047 Dated December 27, 1977

Inventor(s) Walter B. Swan

It is certified that error appears in the above-identified patent and that said Letters Patent are hereby corrected as shown below:

Column 1, line 15, "botton" should be --bottom--.

line 27, "botton" should be --bottom--.

line 42, "botton" should be --bottom--.

Column 2, line 52, "botton" should be --bottom--.

Column 3, line 8, "16" should be --26--.

Column 4, line 8, "for" should be --from--.

line 61, "line" should be --lines--.

UNITED STATES PATENT OFFICE

CERTIFICATE OF CORRECTION

Patent No. 4,065,047 Dated December 27, 1977

Inventor(s) Walter B. Swan

It is certified that error appears in the above-identified patent and that said Letters Patent are hereby corrected as shown below:

Column 6, line 42, "adjacent panel," should be --adjacent bottom panel,--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*